US006706337B2

(12) United States Patent
Hebert

(10) Patent No.: US 6,706,337 B2
(45) Date of Patent: Mar. 16, 2004

(54) ULTRASONIC METHOD FOR APPLYING A COATING MATERIAL ONTO A SUBSTRATE AND FOR CLEANING THE COATING MATERIAL FROM THE SUBSTRATE

(75) Inventor: Thomas K. Hebert, Groveland, MA (US)

(73) Assignee: Agfa Corporation, Wilmington, MA (US)

( * ) Notice: Subject to any disclaimer, the term of this patent is extended or adjusted under 35 U.S.C. 154(b) by 0 days.

(21) Appl. No.: 10/094,742

(22) Filed: Mar. 11, 2002

(65) Prior Publication Data

US 2002/0127346 A1 Sep. 12, 2002

Related U.S. Application Data

(60) Provisional application No. 60/275,093, filed on Mar. 12, 2001.

(51) Int. Cl.[7] ..... B06B 1/00

(52) U.S. Cl. ..... 427/600; 427/140; 427/144; 427/256; 101/450.1; 101/463.1; 101/467

(58) Field of Search ..... 427/600, 140, 427/144, 256; 101/450.1, 467, 463.1

(56) References Cited

U.S. PATENT DOCUMENTS 4,782,753 A * 11/1988 Bolza-Schunemann ..... 101/363
5,540,384 A * 7/1996 Erickson et al. ..... 239/102.2
6,033,740 A * 3/2000 Oelbrandt et al. ..... 427/511

FOREIGN PATENT DOCUMENTS

JP 11-300974 * 11/1999

* cited by examiner

*Primary Examiner*—Katherine A. Bareford
(74) *Attorney, Agent, or Firm*—John A. Merecki; Robert A. Sabourin

(57) ABSTRACT

The present invention provides a method and apparatus for applying a coating material onto a print substrate mounted on a plate cylinder of a printing press. The method comprising: delivering a supply of the coating material to a distributive surface of an ultrasonic horn, the distributive surface controlling a flow of the coating material to an active edge of the ultrasonic horn, and atomizing the coating material at the active edge of the ultrasonic horn and directing the atomized coating material onto a surface of the print substrate. The present invention also provides a multipurpose ultrasonic acoustic coating/cleaning system for applying a coating material onto, and cleaning the coating material from, a print substrate.

34 Claims, 10 Drawing Sheets

ULTRASONIC METHOD FOR APPLYING A COATING MATERIAL ONTO A SUBSTRATE AND FOR CLEANING THE COATING MATERIAL FROM THE SUBSTRATE

This application claims the benefit of U.S. Provisional Application No. 60/275,093, filed on Mar. 12, 2001.

FIELD OF THE INVENTION

The present invention is in the field of imaging systems. More particularly, the present invention provides a method and apparatus for ultrasonically applying a coating material onto a print substrate mounted on the plate cylinder of a printing press. In addition, the present invention provides a method and apparatus for ultrasonically cleaning the coating material from the surface of the print substrate prior to a reapplication of the coating material.

BACKGROUND OF THE INVENTION

Lithography is the process of printing from specially prepared surfaces, some areas of which are capable of accepting lithographic ink, whereas other areas, when moistened by an aqueous dampening liquid, will not accept the ink. The image to be printed is provided on a lithographic printing master, such as a printing plate, which is mounted on the plate cylinder of a printing press. The printing master carries an image that is defined by the ink accepting areas of the printing surface. A print is obtained by applying ink and a dampening liquid to the printing surface and then transferring the ink from the ink accepting areas of the printing master, using a blanket cylinder, onto a substrate, typically formed of paper.

Many techniques have been used to form an image on a printing master. One common technique, often referred to as "computer-to-film," transfers the image to be printed onto a supply of film using an imagesetter. After processing, the film is used as a mask for the imaging of a plate precursor, comprising, for example, a print substrate (e.g., an aluminum substrate) that has been coated with a thin layer of a photosensitive material. The imaged plate precursor is subsequently processed to obtain a printing plate that can be used as a printing master on a printing press.

Another technique, often called "computer-to-plate" or "direct-to-plate," eliminates the need for film by transferring the image to be printed directly onto a plate precursor using a platesetter, an on-press imaging system, etc. The imaged plate precursor is then processed to obtain a printing plate that can be used as a printing master on a printing press. Upon completion of a press run, the printing master is removed from the plate cylinder of the printing press and discarded or recycled. A new printing master is then mounted onto the plate cylinder of the printing press in preparation of the next press run.

Recently, several computer-to-plate "on-press" imaging techniques have been developed that do not require the printing master to be removed from the plate cylinder of the printing plate upon completion of printing. For example, in one technique, a heat-sensitive coating material, capable of forming a lithographic printing form upon imaging and optional processing, is provided directly on the surface of a reusable hydrophilic print substrate mounted on the plate cylinder of the printing press. (Alternately, the coating material may be provided directly on the surface of the plate cylinder itself.) When the press run is complete, the reusable print substrate (or plate cylinder) is cleaned and recoated with the coating material, at which point it is ready for subsequent imaging and printing.

One such computer-to-plate technology, called LiteSpeed™, recently developed by Agfa-Gevaert N.V. of Mortsel, Belgium, uses a polymer-type liquid lithographic coating material, designed to be sprayed or otherwise applied on an anodized aluminum print substrate, to create a lithographic printing form. The lithographic printing form can be imaged using thermal laser technology soon after application, and is then ready for printing. The non-exposed areas are removed from the lithographic printing form during the printing of the first few (e.g., 10) sheets of paper, allowing the press run to begin immediately after imaging without any additional development. At the end of the print run, the print substrate is completely cleaned prior to the next application of LiteSpeed™ and the next concurrent print job. LiteSpeed™ is non-ablative, requires no chemical processing, and each application is equal in performance to a conventional lithographic printing plate, with a run length of approximately 20,000 impressions.

On-press computer-to-plate systems, such as those described above, will require some form of cleaning prior to the reapplication of the coating material on the print substrate. LiteSpeed™, and switchable polymer-type applied coating technologies, often require the removal of all of the applied polymer coating material, inks, and other contaminants prior to reapplication. The print substrate must be clean and dry prior to reapplication. One consequence of contamination is a latent or "ghost image" from the previous print run that may appear in the printed output of the next print run.

Many cleaning techniques have been proposed to clean a surface in a printing press. For example, U.S. Pat. No. 5,713,287 issued to Gelbart on Feb. 3, 1998 and U.S. Pat. No. 5,148,746 issued to Fuller et al. on Sep. 22, 1992, incorporated herein by reference, both describe cleaning devices and methods that use abrasive techniques to disengage materials from a surface. The former uses a cloth blanket type washer. The latter uses a type of brush or pad to dislodge materials, and a fan or other means for removal. The difficulty in these and other types of abrasive methods is the deteriorated surface condition left on the hydrophilic print substrate, and circumferential interruptions in the plate cylinder surface. These methods tend to produce a shorter print run length with less lithographic latitude. Some of the blanket washer types have the added disadvantage of requiring a full axial volume adjacent to the plate cylinder.

Another cleaning technique uses a stream of high pressure water to remove coating materials from the print substrate. After application of a cleaning solution, the stream of high pressure water is sprayed onto the print substrate. The water, removed coating material, inks, cleaner, and other contaminants are then removed from the print substrate using a vacuum system. The print substrate is then dried prior to the reapplication of the coating material. Great care must be taken when using this method to prevent the water and other substances removed from the print substrate from detrimentally affecting the on-press imaging system and other components/functions of the printing press. Subsequent filtration of large amounts of water having solubolized materials requires specialized equipment. As such, this process is difficult and costly to implement.

The coating material is commonly applied to the print substrate using a dedicated system that is independent from the cleaning and imaging systems. For example, the coating material may be applied to the print substrate by a spraying or a rolling system. Unfortunately, since access to the plate cylinder in the printing press is generally very limited, the implementation of separate coating, cleaning, and imaging systems is a complex and costly task.

Thus, there is a need for a method and apparatus for applying coating materials onto a print substrate, and for cleaning the coating materials from the print substrate, that avoids these and other problems present in currently available on-press systems.

SUMMARY OF THE INVENTION

The present invention provides methods and apparatus for applying a coating material onto, and cleaning the coating material from, a surface of a print substrate mounted on the plate cylinder of a printing press using ultrasonic techniques.

Generally, the present invention provides a method for applying a coating material onto a print substrate, comprising:

delivering a supply of the coating material to a distributive surface of an ultrasonic horn, the distributive surface controlling a flow of the coating material to an active edge of the ultrasonic horn, and atomizing the coating material at the active edge of the ultrasonic horn and directing the atomized coating material onto a surface of the print substrate.

The present invention also provides an apparatus for applying a coating material onto a print substrate, comprising:

an ultrasonic horn having a distributive surface and an active edge, and a delivery system for delivering a supply of the coating material to the distributive surface, the distributive surface controlling a flow of the coating material to the active edge, the active edge atomizing and directing the coating material onto the surface of the print substrate.

The present invention further provides an apparatus, comprising:

an ultrasonic horn having an active edge for atomizing and directing a coating material onto a print substrate, and a distributive surface for controlling a flow of the coating material to the active edge.

BRIEF DESCRIPTION OF THE DRAWINGS

The features of the present invention will best be understood from a detailed description of the invention and embodiments thereof selected for the purpose of illustration and shown in the accompanying drawings in which.

DETAILED DESCRIPTION OF THE INVENTION

Figure 1:
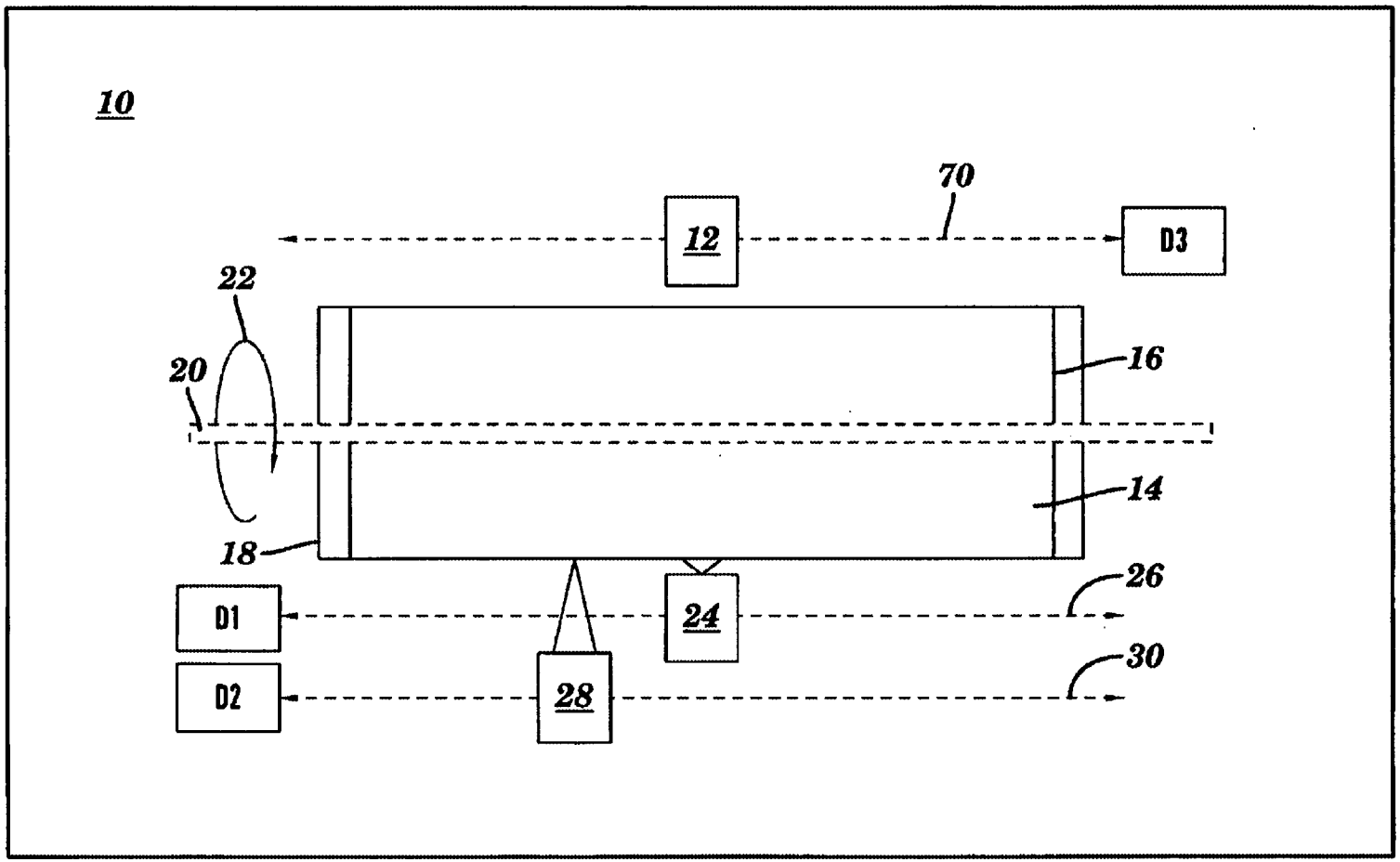
FIG. 1 illustrates a printing press having a plate cylinder, an ultrasonic acoustic coating apparatus for applying a coating material onto a surface of a print substrate mounted on the plate cylinder, and an ultrasonic acoustic cleaning apparatus for cleaning the surface of a print substrate, in accordance with an embodiment of the present invention.

The features of the present invention are illustrated in detail in the accompanying drawings, wherein like reference numerals refer to like elements throughout the drawings. Although the drawings are intended to illustrate the present invention, the drawings are not necessarily drawn to scale.

A printing press 10 having an ultrasonic acoustic cleaning apparatus 12 for cleaning a surface 14 of a reusable print substrate 16 in accordance with the present invention, and an ultrasonic acoustic coating system 24 (or 224, FIG. 8), for applying a coating material onto the surface 14 of the print substrate 16 in accordance with the present invention, is illustrated in FIG. 1. As shown, the reusable print substrate 16 is mounted on a plate cylinder 18 that is configured to rotate about an axis 20 as indicated by directional arrow 22. The printing press 10 is a conventional "on-press" type of printing press in which a coating material, capable of forming a lithographic printing form upon imaging and optional processing (e.g., LiteSpeed™ or switchable polymer-type coatings), is provided directly on the surface 14 of the reusable print substrate 16.

Figure 7:
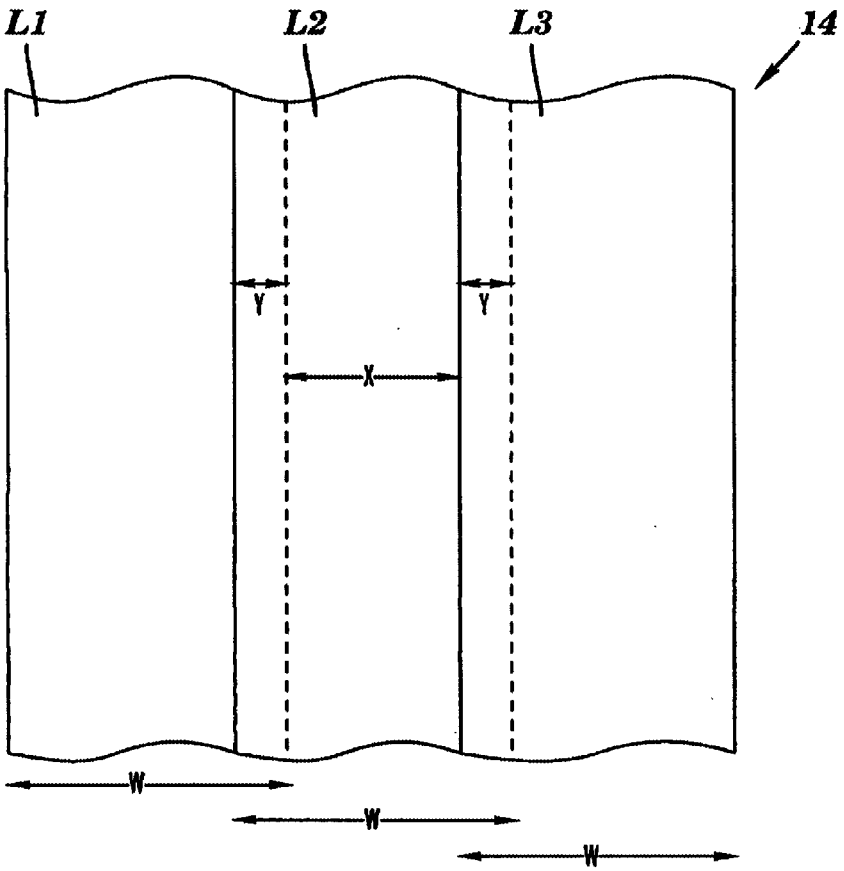
FIG. 7 illustrates several overlapping coating lines produced by the ultrasonic acoustic coating system of the present invention.

In the example illustrated in FIG. 1, the ultrasonic acoustic coating system 24 is used to apply the coating material onto the surface 14 of the reusable print substrate 16 prior to imaging and after the cleaning of the surface 14. A drive system D1 displaces the ultrasonic acoustic coating system 24 axially along the plate cylinder 18 as indicated by directional arrow 26 during the application of the coating material. As shown in FIG. 7, the coating material is applied in a helical pattern on the surface of the print substrate 16, with an amount of overlap between adjacent coating lines L1, L2, L3, . . . , as the ultrasonic acoustic coating system 24 is displaced axially along the rotating plate cylinder 18.

An imaging system 28 is provided to form an image on the coating material that has been applied on the surface 14 of the reusable print substrate 16 by the ultrasonic acoustic coating system 24. The imaging system 28 can comprise any type of system capable of exposing an image on the coating material. For example, the imaging system may comprise means for generating one or more laser beams and for directing the laser beam(s) onto the coating material to form an image thereon. A drive system D2 is used to displace the imaging system 28 axially along the plate cylinder 18 during imaging (i.e., in a "slow scan" direction) as indicated by directional arrow 30.

Figure 2:
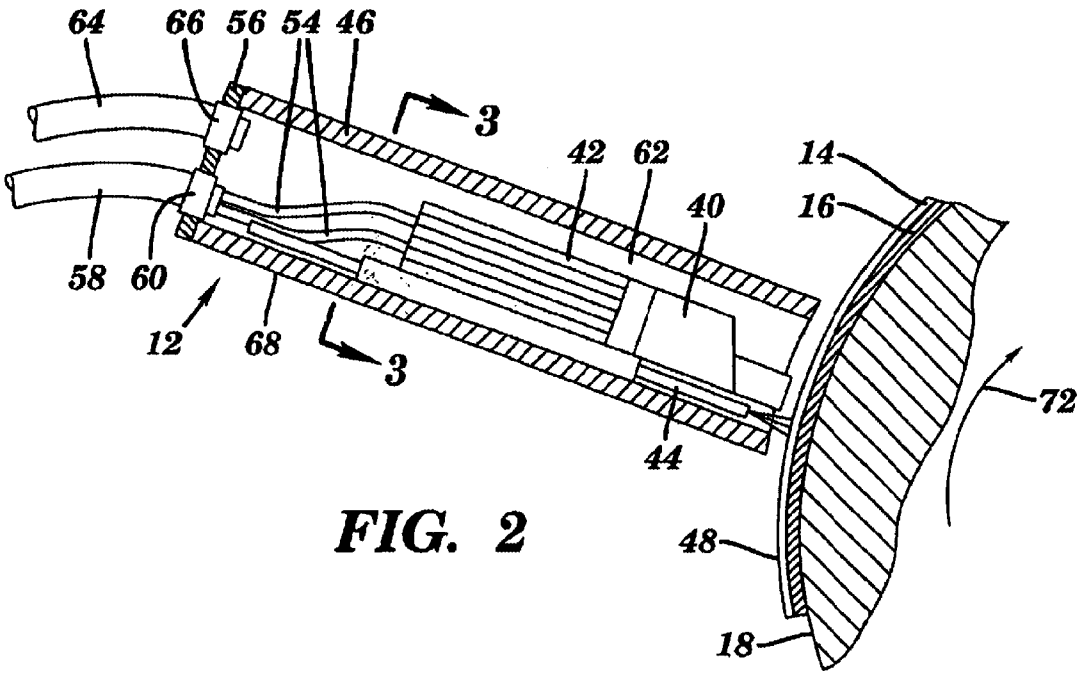
FIG. 2 is a cross-sectional view of a first embodiment of an ultrasonic acoustic cleaning apparatus in accordance with the present invention.
Figure 3:
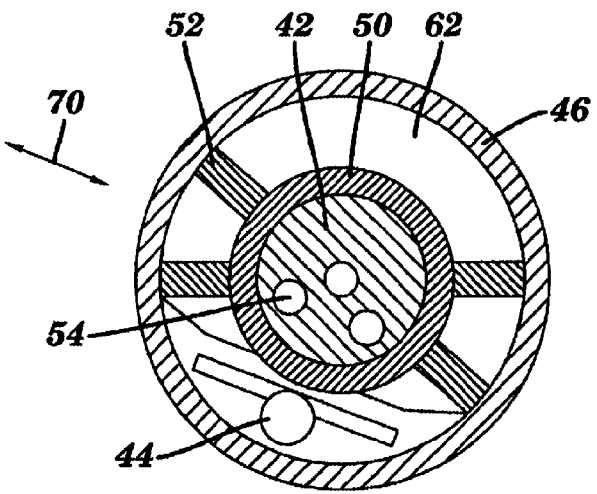
FIG. 3 is a cross-sectional view taken along line 3—3 of FIG. 2.

A cross-sectional view of a first embodiment of the ultrasonic acoustic cleaning apparatus 12 in accordance with the present invention is illustrated in FIG. 2. A cross-sectional view of the ultrasonic acoustic cleaning apparatus 12 taken along line 3—3 of FIG. 2 is illustrated in FIG. 3. The ultrasonic acoustic cleaning apparatus 12 includes an ultrasonic system comprising an ultrasonic horn 40 and an ultrasonic transducer 42 for driving the ultrasonic horn 40. The ultrasonic acoustic cleaning apparatus 12 further includes a spray nozzle 44 for supplying an atomized spray of a cleaning solution. The ultrasonic horn 40, ultrasonic transducer 42, and the spray nozzle 44 are all enclosed within a vacuum cannula 46. As shown in FIG. 2, the ultrasonic acoustic cleaning apparatus 12 is positioned in close proximity to the surface 14 of the print substrate 16. The particular distance of the ultrasonic acoustic cleaning apparatus 12 from the surface 14 of the print substrate 16 is generally application specific, and may be dependent upon many factors, including the power of the ultrasonic transducer 42, the configuration of the ultrasonic horn 40, the type of spray nozzle 44 used, the strength of the vacuum applied within the vacuum cannula 46, the material properties of the coating material 48 to be removed from the surface 14 of the print substrate 16, etc. Similarly, the power of the ultrasonic transducer 42 is generally application specific, and may be dependent upon factors including those presented above. For example, the power of the ultrasonic transducer 42 may be in the range of about 1500 to 6000 watts. Other power values are also possible.

Referring to FIG. 3, the ultrasonic transducer 42 is supported within a housing 50 along a center of the vacuum cannula 46. The housing 50 is attached to an inner surface of the vacuum cannula 46 by a plurality of radially extending ribs 52. Power/control lines 54 of the ultrasonic transducer 42 extend out of the end 56 of the vacuum cannula 46 into a hose 58 through connector 60.

A vacuum is supplied to a vacuum port 62 within the vacuum cannula 46 by a vacuum source (not shown). The vacuum source is coupled to the vacuum port 62 via hose 64 and connector 66.

Cleaning solution is supplied to the spray nozzle 44 through a supply line 68. The supply line 68 extends through connector 60 into hose 58.

In accordance with the present invention, the ultrasonic acoustic cleaning apparatus 12 is used to clean the surface 14 of the print substrate 16 after a print run and before reapplication of the coating material 48. In particular, as shown in FIG. 2, a cleaning solution is directed onto the surface 14 of the print substrate 16 through spray nozzle 44 as the plate cylinder 18 rotates as indicated by directional arrow 72 past the vacuum cannula 46. After passing under the spray nozzle 44, the surface 14 subsequently rotates under the ultrasonic horn 40, which operates to remove the coating material 48 from the surface 14. As rotation of the press-cylinder 18 continues, all debris from the cleaning process is collected and removed through the vacuum port 62. During the cleaning process, the ultrasonic acoustic cleaning apparatus 12 is displaced by a drive system D3 axially along the plate cylinder 18 in a "slow-scan" direction as indicated by directional arrow 70 (see FIGS. 1 and 3). After cleaning, the print substrate 16 may be "refreshed" if necessary using a water rinse.

In previous cleaning systems, a solvent-type cleaning solution was applied on the surface of the print substrate. After waiting some dwell period to allow the solvent to sufficiently soften the bonded polymer of the coating material, the coating material was removed by mechanical means (e.g., scrubbed with a brush or roller). The resultant waste material was then rinsed from the print substrate, and the substrate was dried using hot air. The cleaning solution of the present invention, however, is not only used for its inherent solvent cleaning/softening function, but also as a coupling agent for the ultrasonic horn 40. In particular, when sprayed as a mist between the ultrasonic horn 40 and the print substrate 16, the atomized cleaning solution couples and focuses the energy of the ultrasonic horn 40 to the coating material 48 on the surface 14 of the print substrate 16. The focused energy promotes acoustic cavitation. This cavitation is the result of excitation at the molecular level of the coupling liquid (i.e., the cleaning solution) on and at the coating material 48. The excitation causes friction and thus turns the acoustic energy to heat. The heat causes the water molecules of the cleaning solution to move apart forming gas or steam which condenses on colder surrounding areas, thereby causing voids to develop. Adjacent molecules fill in the voids, violently sending shock waves through the coating material 48 and initiating a series of subsequent chain reactions and surface implosions. This causes the coating material 48 (e.g., polymer) to be instantly softened and "blasted" from the surface 14 of the print substrate 16. The softening characteristic of the solvent is so enhanced by cavitation that the cleaning of the surface 14 of the print substrate 16 is immediate and complete so as not to require additional mechanical cleaning.

In accordance with one embodiment of the present invention, the cleaning solution is an aqueous-based solvent-type cleaning solution that is specifically formulated to soften the coating material 48 on the surface 14 of the print substrate 16. As detailed above, this type of cleaning solution, when sprayed onto the coating material, also serves to focus the energy of the ultrasonic horn 40 onto the coating material 48 to initiate and sustain acoustic cavitation. In general, however, any suitable type of atomized aqueous spray, including plain water, may be used to couple and focus the energy of the ultrasonic horn 40 onto the coating material 48 on the surface 14. Of course, the choice of cleaning solution is dependent on many different factors, including, for example, the desired processing time, the material characteristics of the coating material 48, the power of the ultrasonic transducer 42, etc.

During and after the cleaning process a vacuum is drawn within the vacuum port 62 of the vacuum cannula 46. The vacuum removes any excess cleaning solution and all of the debris resulting from the cleaning process from the surface 14 of the print substrate 16. This leaves the surface 14 clean and dry. The removed materials are subsequently transferred through the hose 64 to entrainment separators (not shown) for collection and disposal.

The ultrasonic acoustic cleaning apparatus 12 of the present may be used as a stand-alone device as shown in FIG. 1, or may be coupled to other components of the printing press 10. For example, the ultrasonic acoustic cleaning apparatus 12 may be coupled to the imaging system 28. As such, a separate drive system for the ultrasonic acoustic cleaning apparatus 12 is not required; displacement of the ultrasonic acoustic cleaning apparatus 12 is provided by the drive system D2 of the imaging system 28 (or vice-versa). This configuration may be useful, for example, when access to the plate cylinder 18 in the printing press 10 is limited. It should be apparent that the ultrasonic acoustic cleaning apparatus 12 could also be coupled to the ultrasonic acoustic coating system 24. In this case, displacement of the ultrasonic acoustic cleaning apparatus 12 is provided by the drive system D1 of the ultrasonic acoustic coating system 24 (or vice-versa).

Figure 4:
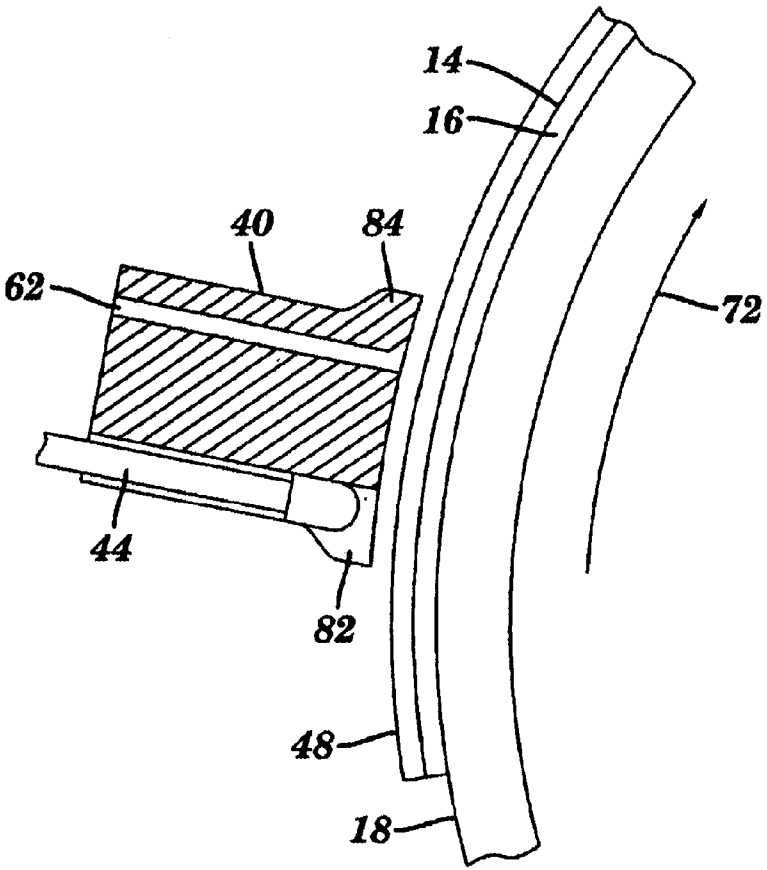
FIG. 4 illustrates an ultrasonic acoustic cleaning apparatus in accordance with another embodiment of the present invention.

Another embodiment of an ultrasonic acoustic cleaning apparatus 80 is illustrated in FIG. 4. In this embodiment, the vacuum port 62 and the spray nozzle 44 are incorporated within the body of the ultrasonic horn 40. This provides a more compact system. With the ultrasonic horn 40 excited, cleaning solution is introduced by the spray nozzle 44 at the leading end 82 of the ultrasonic horn 40 where cavitation begins. As the plate cylinder 18 continues to rotate, the coating material 48 is loosened and removed from the surface 14 of the print substrate 16 by the cavitation process. Any remaining cleaning solution and debris from the cleaning process is sucked from the surface 14 into the vacuum port 62 as the surface 14 passes under the trailing end 84 of the ultrasonic horn 40.

Figure 5:
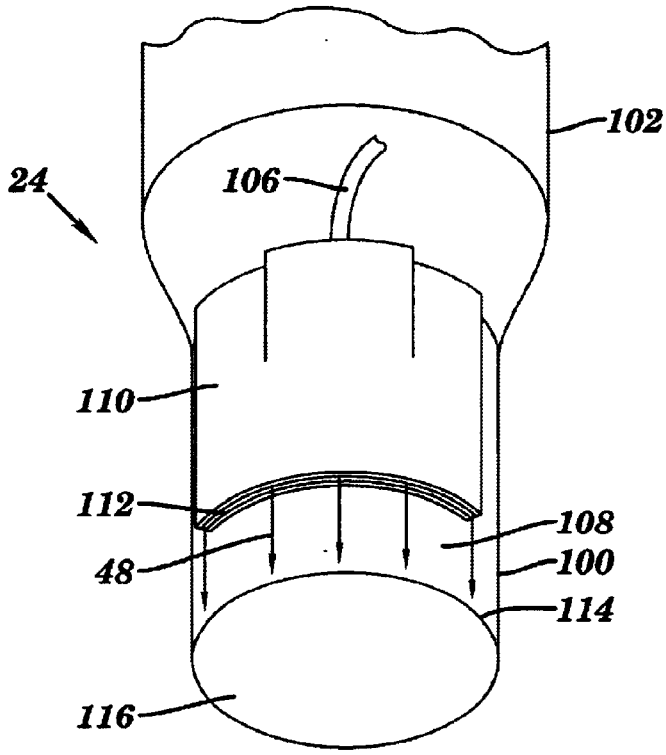
FIG. 5 illustrates an embodiment of an ultrasonic acoustic coating system in accordance with the present invention.
Figure 6A:
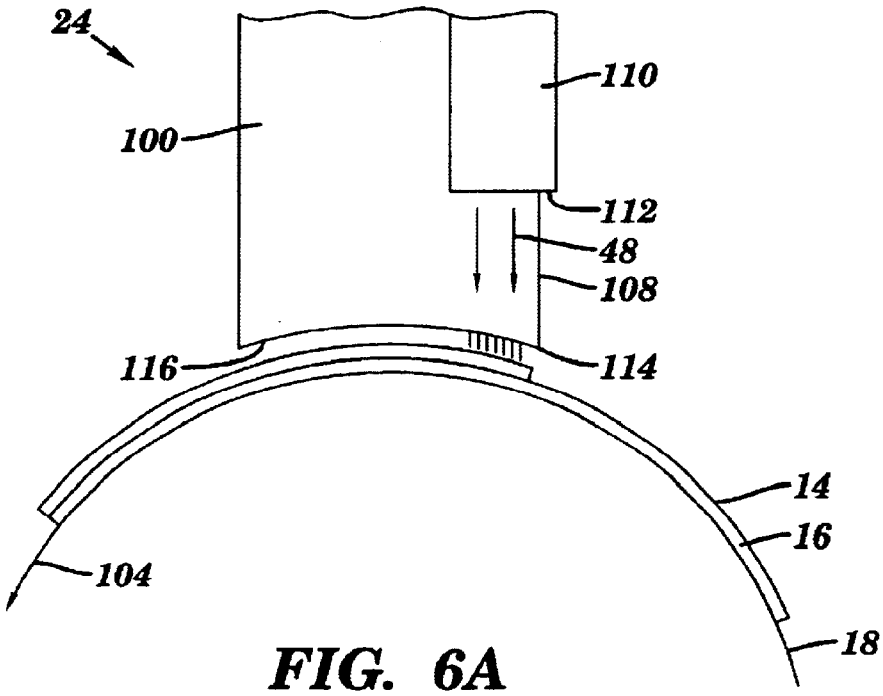
FIG. 6A is a cross-sectional view of the ultrasonic acoustic coating system of FIG. 5 with the ultrasonic horn positioned vertically over a plate cylinder.
Figure 6B:
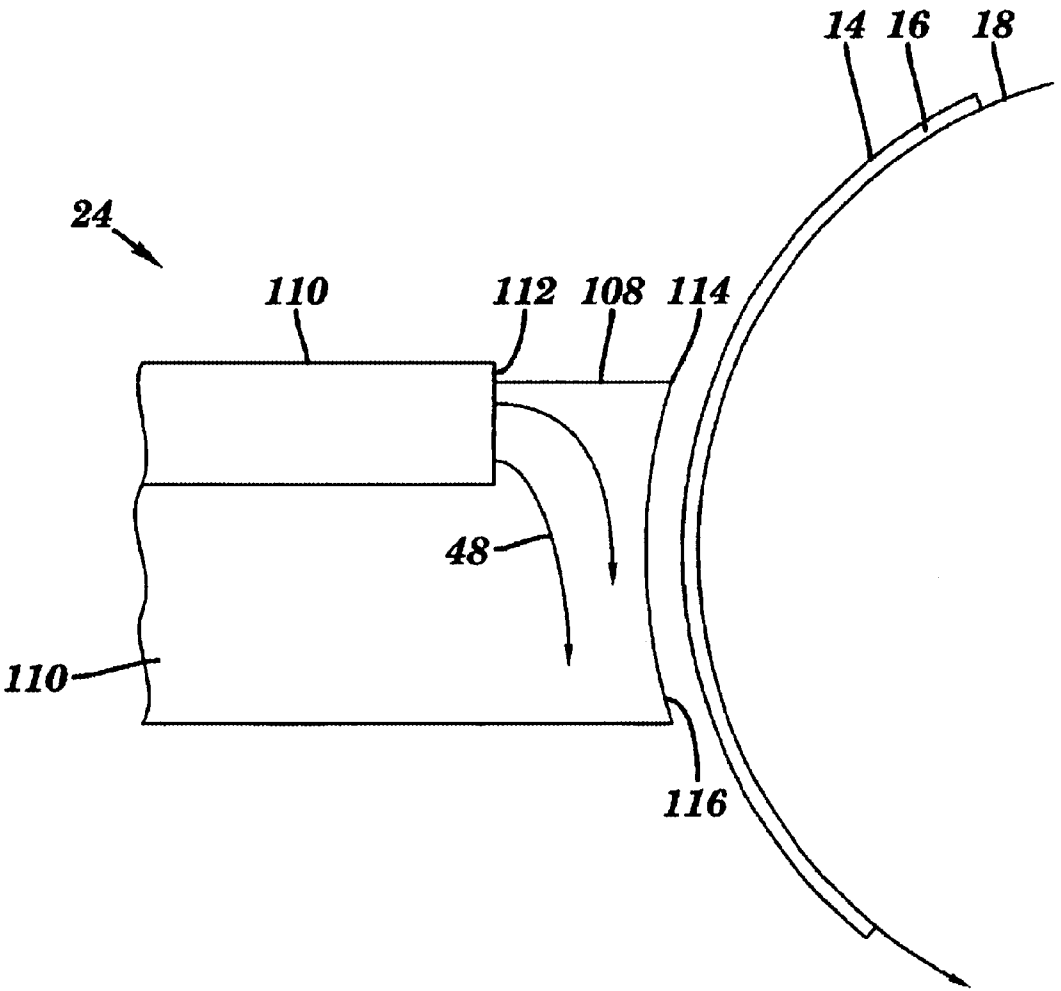
FIG. 6B is a cross-sectional view of the ultrasonic acoustic coating system of FIG. 5 with the ultrasonic horn positioned horizontally next to a plate cylinder

A first embodiment of an ultrasonic acoustic coating system 24 in accordance with the present invention is illustrated in FIGS. 5 and 6A–6B. The ultrasonic acoustic coating system 24 includes an ultrasonic system comprising an ultrasonic horn 100 and an ultrasonic transducer 102 for driving the ultrasonic horn 100. A metered amount of the coating material 48, provided via a supply line 106, is delivered to a surface 108 of the ultrasonic horn 100 using a nozzle 110. The nozzle may comprise a wide, flat nozzle as shown in FIG. 5, or an array of smaller nozzles arranged adjacent to one another. Other configurations of the nozzle 110 are also possible. After passing out of a fluid delivery exit 112 of the nozzle 110 onto the surface 108, a flow of the coating material 48 passes over the surface 108 toward an active edge 114 of the active surface 116 of the ultrasonic horn 100. The active surface 116 has a curvature corresponding to the curvature of the plate cylinder 18. Alternately, the active surface 116 may be flat or may have any other suitable surface profile.

As shown in FIG. 6A, the ultrasonic horn 100 of the ultrasonic acoustic coating system 24 may be positioned vertically over the plate cylinder 18. This ensures that the coating material 48 supplied by the nozzle 110 will flow downward over the surface 108 toward the active edge 114 of the ultrasonic horn 100. The active edge 114 atomizes the coating material 48 and directs the atomized coating material 48 onto the surface 14 of the plate cylinder 16 in a predetermined atomization pattern. As the ultrasonic acoustic coating system 24 is moved axially along the rotating plate cylinder 18 by drive system D1 (FIG. 1), the atomized coating material 48 is applied in a helical pattern of interlaced, overlapping, coating lines L (FIG. 7) on the surface 14 of the print substrate 16 as the plate cylinder 18 rotates in direction 104.

In many printing presses, vertical access to the plate cylinder 18 is generally not available. Often, however, the plate cylinder 18 may be accessed from one or both sides. Such a case is illustrated in FIG. 6B, wherein the ultrasonic horn 100 of the ultrasonic acoustic coating system 24 is oriented horizontally next to a side of the plate cylinder 18. Unfortunately, when the ultrasonic horn 100 of the ultrasonic acoustic coating system 24 is oriented horizontally, or along a partially horizontal vector, some of all of the coating material 48 will fall by gravity off of the surface 108 of the ultrasonic horn 100 before reaching the active edge 114.

Figure 8:
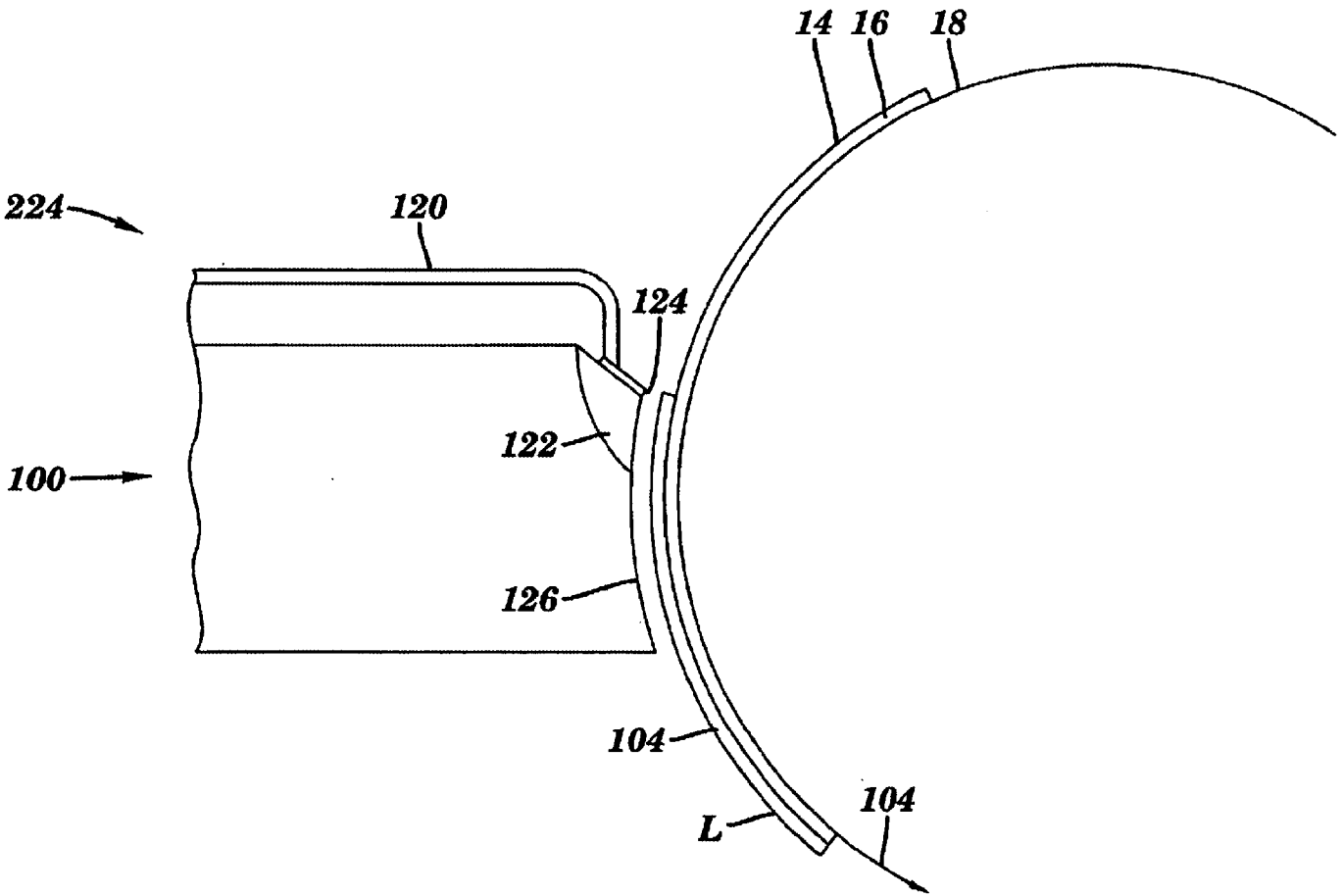
FIG. 8 illustrates another embodiment of an ultrasonic acoustic coating system in accordance with the present invention.

Another embodiment of an ultrasonic acoustic coating system 224, which solves the gravity fall off problem detailed above, is illustrated in FIG. 8. The ultrasonic acoustic coating system 224 includes a distributive surface 122 on the ultrasonic horn 100 for controlling the flow boundaries of the coating material 48. The distributive surface 122 allows the ultrasonic horn 100 of the ultrasonic acoustic coating system 224 to be positioned horizontally, or along a partially horizontal vector, relative to the plate cylinder 18.

Figure 10:
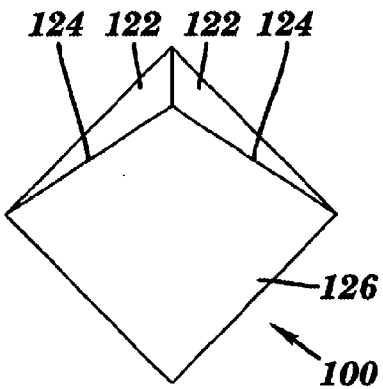
FIGS. 9 and 10 illustrate exemplary distributive surfaces for use in the ultrasonic acoustic coating system of FIG. 8.

In this embodiment, as shown in FIG. 8, a capillary tube 120 is placed and pointed to produce a desired flow pattern of the coating material 48 on the distributive surface 122. In particular, the coating material 48 is delivered by the capillary tube 120 at a prescribed pressure and delivery angle incident on the distributive surface 122 of the ultrasonic horn 100. When constrained only by the surface curvature/shape of the distributive surface 122, the flow of coating material 48 thins and spreads outwardly from the line pressure. When the flow momentum slows from the decreasing pressure, surface tension and molecular cohesion begin to make the flow recede. The distributive surface 122 is designed such that this "energy boundary" occurs at the active edge 124 of the active surface 126 of the ultrasonic horn 100. Exemplary distributive surfaces 122, active edges 124, and active surfaces 126 for circular and square-shaped ultrasonic horns 100 are illustrated in FIGS. 9 and 10, respectively.

The coating material 48 is atomized at the active edge 124 of the ultrasonic horn 100. The ultrasonic horn 100 may be located very near to the surface 14 of the print substrate 16 since no mixing or shaping distance is required for air atomization. The atomized coating material 48 is directed by the active edge 124 onto the surface 14 of the plate cylinder 16 in a predetermined atomization pattern. As the ultrasonic acoustic coating system 224 is moved axially along the rotating plate cylinder 18 by drive system D1 (FIG. 1), the atomized coating material 48 is applied in a helical pattern of interlaced coating lines L1, L2, L3, . . . , on the surface 14 of the print substrate 16. To ensure complete coverage on the surface 14, the coating lines L1, L2, L3, are applied in an overlapping manner as shown, for example, in FIG. 7. The amount of overlap is dependent upon many factors, including the properties of the coating material, the range of acceptable thickness variations of the coating material 48 on the surface 14 of the print substrate 16, etc. At this point, the print substrate 16 is ready for imaging and printing as detailed above with regard to printing press 10 (FIG. 1).

In many cases, it may be desirable to selectively control the thickness profile of the pattern of atomized coating material 48 that is applied on the surface 14 of the print substrate 16. For example, it may be useful to reduce or "feather" the thickness of the pattern in the overlapping areas of the coating lines to maintain a substantially uniform thickness of the coating material across the surface 14 of the print substrate 16. An exemplary overlapping technique places sixty-six percent of the volume of the coating material 48 over a particular dimension (e.g., X in FIG. 7), while the remaining thirty-three percent of the volume of the coating material 48 is divided between the regions of overlap (e.g., Y), thereby resulting in a uniform fill volume. This may be accomplished by regulating the flow volume of the coating material 48 reaching selective regions on the active edge 114 of the ultrasonic horn 100.

Figure 9:
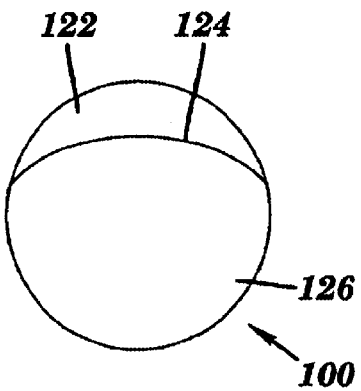
Figure 11:
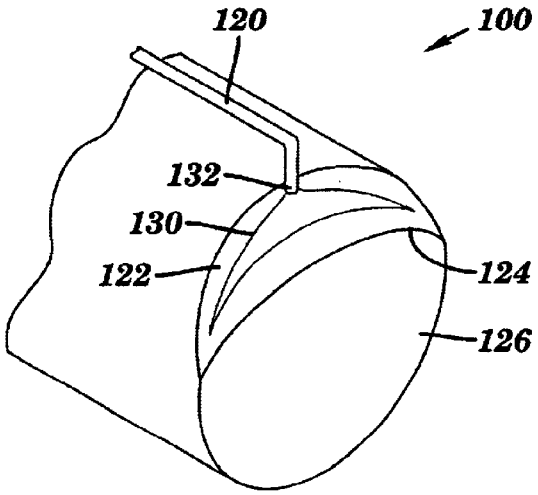
FIGS. 11 and 12 illustrate the flow boundaries of the coating material, provided by a capillary tube, on the distributive surfaces of FIGS. 9 and 10, respectively.

FIG. 11 illustrates the flow boundaries 130 of the coating material 48 on the distributive surface 122 of the ultrasonic horn 100 of FIG. 9. As shown, the flow volume of the coating material 48 is the highest in the center section of the distributive surface 122 immediately below the exit opening 132 of the capillary tube 120, where it is pushed out under pressure. The flow volume gradually decreases away from the center section of the distributive surface 122 as the coating material 48 spreads out toward the sides of the distributive surface 122. Thus, the flow volume of the coating material 48 reaching the active edge 124 is not uniform. This results in a feathered pattern being produced on the surface 14 of the print substrate 16.

Figure 12:
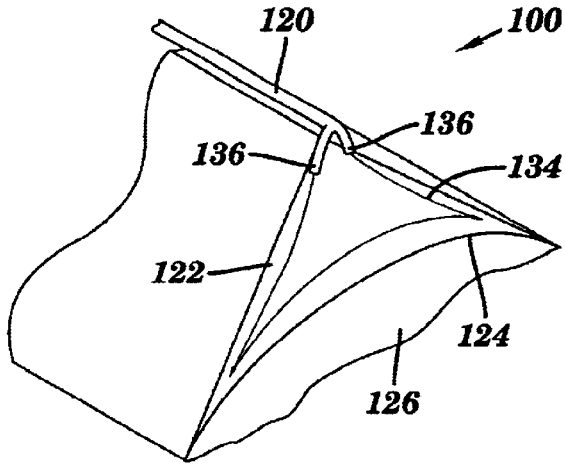

FIG. 12 illustrates the flow boundaries 134 of the coating material 48 on the distributive surface 122 of the ultrasonic horn 100 of FIG. 10. As shown, the flow volume of the coating material 48 is the highest in the center section of the distributive surface 122 immediately below the exit openings 136 of the capillary tube 120, where it is pushed out under pressure. The flow volume gradually decreases away from the center section of the distributive surface 122 as the coating material 48 spreads out toward the sides of the distributive surface 122. Thus, the flow volume of the coating material 48 reaching the active edge 124 is not uniform. Again, this results in a feathered pattern being produced on the surface 14 of the print substrate 16.

Figure 13:
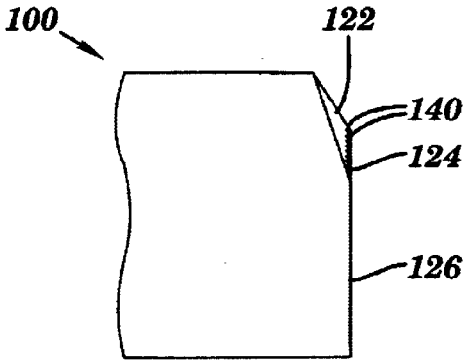
FIGS. 13 and 14 illustrate an ultrasonic horn configured to produce a plurality of small jets of atomized coating material.
Figure 14:
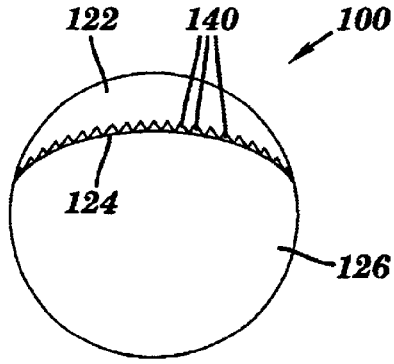

FIGS. 13 and 14 illustrate an ultrasonic horn 100 configured to produce and direct a plurality of small jets of atomized coating material 48 toward the surface 14 of the print substrate 16. As shown, an array of openings 140 or the like (e.g., holes, grooves, etc.) are formed on or in the distributive surface 122 at the active edge 124 of the ultrasonic horn 100. In this embodiment, the coating material 48 flows down the distributive surface 122 into the openings 140 at the active edge 124 where it is atomized and directed toward the surface 14 of the print substrate 16. The array of openings 140 may all have the same size and configuration to produce uniform jets of atomized coating material 48, or may be selectively configured and arranged to produce non-uniform jets of atomized coating material to form a specific pattern of the coating material on the surface 14 of the print substrate 16. For example, by making the openings 140 larger in the center portion of the active edge 124, and smaller near the sides of the active edge 124, a feathered pattern of the coating material 48 can be produced on the surface 14 of the print substrate 16.

Figure 15:
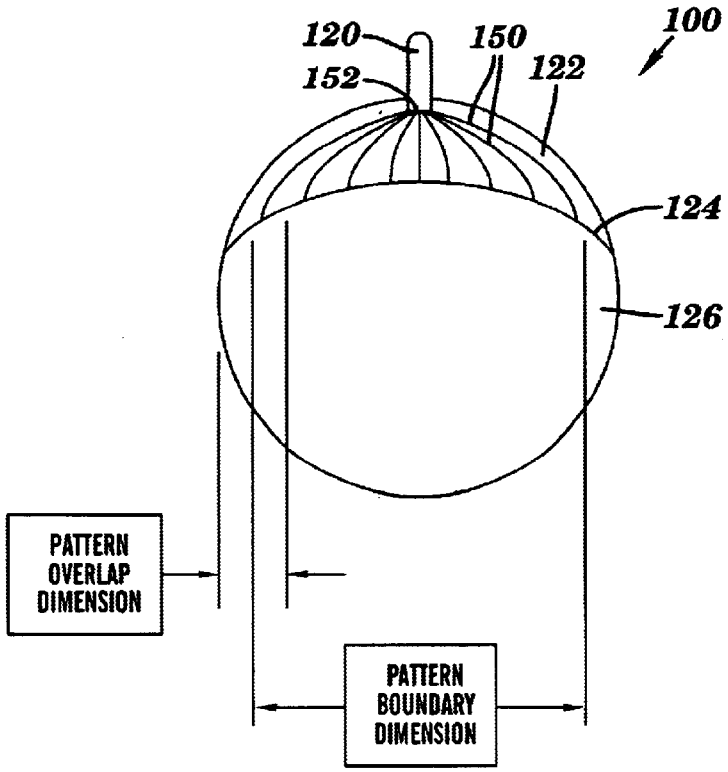
FIG. 15 illustrates the use of lined depressions in the distributive surface for controlling the flow boundaries of the coating material.

As shown in FIG. 15, a series of lined depressions 150, formed (e.g., etched) in the distributive surface 122 and emanating from a delivery exit 152 of a capillary tube 120, may be used to control the flow boundaries of the coating material 48 reaching the active edge 124, thereby controlling the resultant pattern boundary dimension of the pattern formed on the surface 14 of the print substrate 16. The depth of the lined depressions 150 may be varied to control the features of the pattern formed on the surface 14 of the print substrate 16. For example, a feathered pattern may be produced by forming deeper lined depressions 150 in the center portion of the distributive surface 122 and shallower lined depressions 150 toward the sides of the distributive surface 122. An exemplary pattern overlap dimension for such a feathered pattern is shown in FIG. 15.

Figure 16:
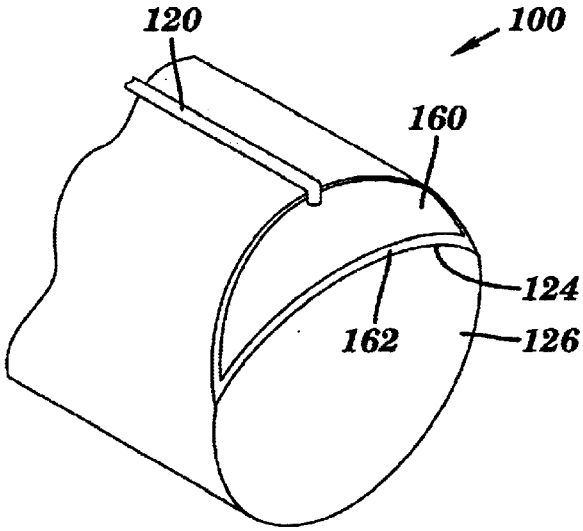
FIGS. 16 and 17 illustrate another method for controlling the flow boundaries of the coating material.
Figure 17:
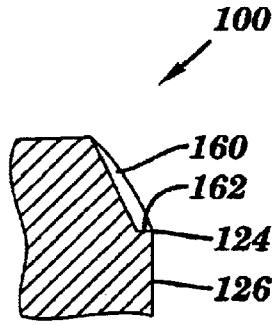

In another embodiment of the present invention, as shown in FIGS. 16 and 17, flow control of the coating material 48 can be provided using a non-uniform channel 160 and a shallow weir 162 formed at the active edge 124. The non-uniform channel 160 may have a variable depth such that the channel 160 is deeper in the middle than at the edges. In this configuration, the weir 162 helps to ensure uniformity across the flow front to provide uniform atomization of the coating material 48.

Figure 18:
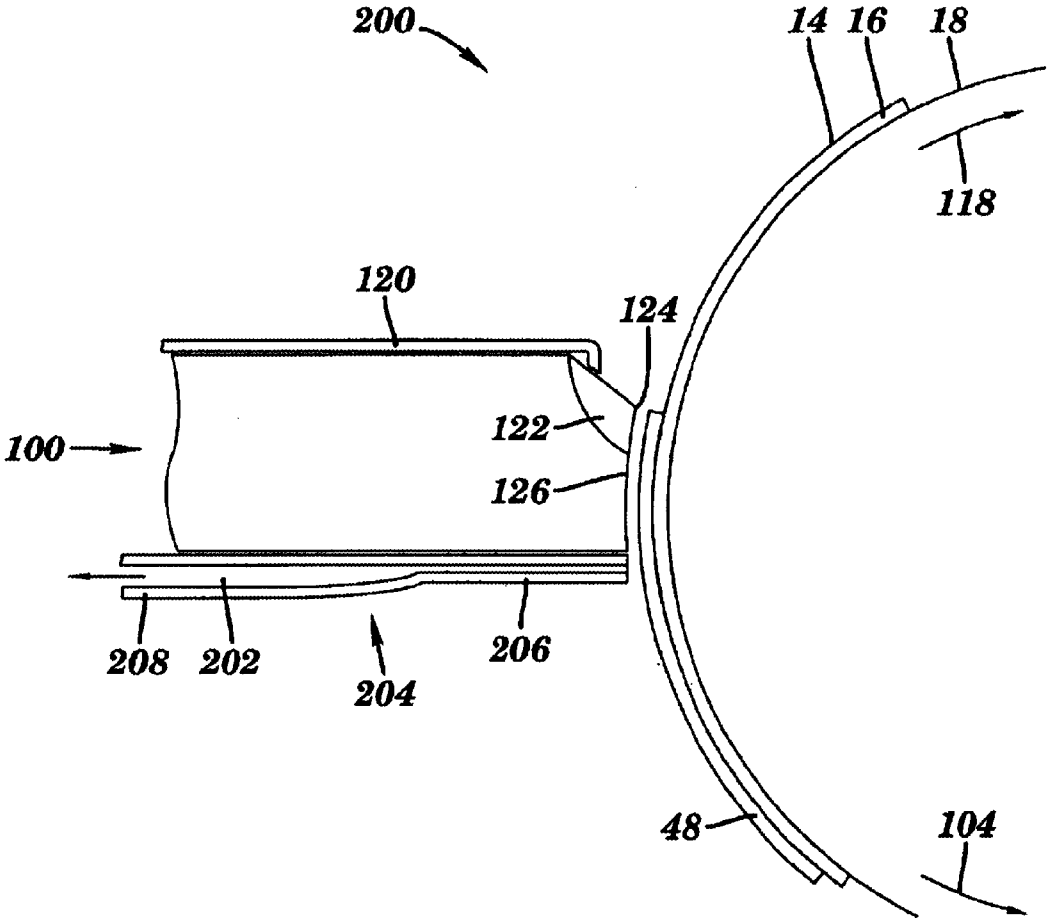
FIG. 18 illustrates a multi-purpose ultrasonic acoustic coating/cleaning apparatus in accordance with the present invention.

The operation of the ultrasonic acoustic coating apparatus 224 and the ultrasonic acoustic cleaning apparatus 12 of the present invention may be combined to produce a multi-purpose ultrasonic acoustic coating/cleaning system 200. An example of such a multi-purpose ultrasonic acoustic coating/cleaning system 200 is illustrated in FIG. 18. The ultrasonic coating/cleaning system 200 incorporates an ultrasonic horn 100, such as that shown in FIG. 8. Other embodiments of the ultrasonic horn 100 may also be used in the ultrasonic coating/cleaning system 200.

During a coating operation, the plate cylinder 18 is rotated in direction 104. As detailed above with regard to FIG. 8, a supply of the coating material 48 is delivered by a capillary tube 120 to a distributive surface 122. The coating material 48 flows across the distributive surface 122 to the active edge 124 of the active surface 126 of the ultrasonic horn 100, where it is atomized and directed onto the surface 14 of the print substrate 16 in a predetermined pattern. As the ultrasonic coating/cleaning apparatus 200 is moved axially along the rotating plate cylinder 18 by a drive system (e.g., D1 or D3, FIG. 1), the atomized coating material 48 is applied in a helical pattern of interlaced, overlapping, coating lines L (FIG. 7) on the surface 14 of the print substrate 16.

Figure 19:
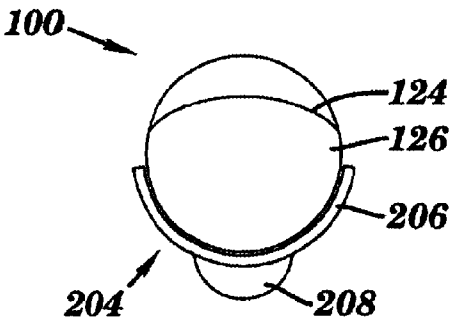
FIG. 19 is an end view of a vacuum nozzle used in the ultrasonic acoustic coating/cleaning apparatus of FIG. 18.

After the thus applied coating material has been imaged, and subsequently used for printing on a printing press, the ultrasonic coating/cleaning apparatus 200 can be employed to completely clean the surface 14 of the print substrate 16 in a manner similar to that described with reference to the ultrasonic acoustic cleaning apparatus 12 shown in FIG. 2. In particular, while rotating the plate cylinder 18 in direction 118 (i.e., in a direction opposite to direction 104), a supply of a cleaning solution is delivered via the capillary tube 120 to the distributive surface 122. The cleaning solution flows across the distributive surface 122 to the active edge 124 of the active surface 126 of the ultrasonic horn 100, where it is atomized and directed toward and onto the surface 14 of the print substrate. After passing under the active edge 124, the surface 14 subsequently rotates under the active surface 126 of the ultrasonic horn 100, where the coating material 48 is removed from the surface 14 by the above-described cavitation process. As rotation of the press-cylinder 18 continues, all debris from the cleaning process is collected and removed through the vacuum port 202 of a vacuum nozzle 204. As shown in FIG. 19, the vacuum nozzle 204 comprises a semi-circular evacuation portion 206 that covers the lower hemisphere of the ultrasonic horn 100, and a hose portion 208. The semi-circular evacuation portion 206 is used to collect the cleaning solution and debris from the cleaning process. The hose portion 208 transfers the collected material to a collection and disposal system.

The foregoing description of the present invention has been presented for purposes of illustration and description. It is not intended to be exhaustive or to limit the invention to the precise form disclosed, and many modifications and variations are possible in light of the above teaching. For example, the ultrasonic acoustic coating apparatus of the present invention may be used to apply a coating material onto many different types of surfaces, including the surface of a plate cylinder. Moreover, the ultrasonic acoustic cleaning apparatus may be used to clean a coating material from many types of surfaces, including the surface of a plate cylinder. Such modifications and variations that may be apparent to a person skilled in the art are intended to be included within the scope of this invention.

What is claimed is:

1. A method for applying a coating material onto a print substrate, comprising:

delivering a supply of the coating material, which is capable of forming a lithographic printing form upon subsequent imaging, to a distributive surface of an ultrasonic horn, the distributive surface controlling a flow of the coating material to an active edge of the ultrasonic horn;

atomizing the coating material at the active edge of the ultrasonic horn and directing the atomized coating material onto a surface of the print substrate;

applying the coating material in an overlapping pattern of coating lines; and controlling a thickness profile of each coating line to maintain a substantially uniform thickness of the coating material on the print substrate.

2. The method of claim 1, wherein the print substrate is mounted onto a plate cylinder of a printing press.

3. The method of claim 2, further comprising:

displacing the ultrasonic horn axially along the plate cylinder during application of the coating material onto the print substrate.

4. The method of claim 1, wherein applying the coating material comprises applying the coating material in a helical pattern on the print substrate.

5. The method of claim 4, wherein applying the coating material in a helical pattern comprises:

applying the coating material in a helical pattern of interlaced coating lines.

6. The method of claim 1, wherein controlling a thickness profile of each coating line comprises:

reducing a thickness of the coating material in areas of each coating line that overlap, or are overlapped by, areas of an adjacent coating line.

7. The method of claim 6, wherein reducing a thickness of the coating material comprises:

placing a first percent volume of coating material over a particular dimension of the coating line; and placing a second percent volume of coating material in regions of overlap of the coating line.

8. The method of claim 1, wherein controlling a thickness profile of each coating line comprises:

regulating a flow volume of the coating material reaching selective regions of the active edge of the ultrasonic horn.

9. The method of claim 8, wherein regulating the flow volume of the coating material comprises:

applying the coating material to a center region of the distributive surface of the ultrasonic horn.

10. The method of claim 8, wherein regulating the flow volume of the coating material comprises:

forming a plurality of openings at the active edge of the ultrasonic horn.

11. The method of claim 10, wherein forming a plurality of openings comprises:

forming different size openings in different regions of the active edge to provide non-uniform jets of atomized coating material.

12. The method of claim 11, wherein providing different size openings comprises:

forming larger openings in a central region of the active edge; and providing smaller openings in side regions of the active edge.

13. The method of claim 8 wherein regulating the flow volume of the coating material comprises:

forming a series of lined depressions in the distributive surface.

14. The method of claim 13, wherein forming a series of lined depressions comprises:

varying a depth of the series of lined depressions in the distributive surface.

15. The method of claim 14, wherein varying a depth comprises:

forming deeper lined depressions in a central region of the distributive surface; and forming shallower lined depressions in side regions of the distributive surface.

16. The method of claim 8, wherein regulating the flow volume of the coating material comprises:

forming a channel in the distributive surface; and forming a weir at the active edge.

17. The method of claim 16, wherein the channel has a non-uniform depth.

18. The method of claim 17, wherein the channel is deeper in a central region of the distributive surface than in side regions of the distributive surface.

19. The method of claim 1, wherein the print substrate is reusable.

20. The method of claim 1, wherein the print substrate comprises a surface of a plate cylinder of a printing press.

21. The method of claim 1, further comprising:

positioning the ultrasonic horn substantially vertically over the surface of the print substrate.

22. The method of claim 1, further comprising:

positioning the ultrasonic horn substantially horizontally relative to the print substrate.

23. The method of claim 1, further comprising:

positioning the ultrasonic horn along at least a partially horizontal vector, relative to the print substrate.

24. The method of claim 1, wherein delivering a supply of the coating material further comprises:

delivering the coating material to the distributive surface via a capillary tube.

25. The method of claim 1, wherein the coating material comprises a liquid lithographic coating material.

26. The method of claim 25, wherein the liquid lithographic coating material is heat-sensitive.

27. The method of claim 26, further comprising, after application of the coating material on the surface of the print substrate:

imaging data onto the applied coating material using thermal imaging.

28. The method of claim 27, further comprising, after imaging:

applying ink and a dampening liquid onto the surface of the print substrate; and transferring the ink from ink accepting areas of the print substrate onto a print material.

29. The method of claim 28, further comprising:

cleaning the surface of the print substrate; and reapplying the coating material.

30. The method of claim 1, wherein the coating material comprises a switchable polymer-type coating.

31. A method for applying a coating material onto a print substrate, comprising:

delivering a supply of the coating material, which is capable of forming a lithographic printing form upon subsequent imaging, to a distributive surface of an ultrasonic horn, the distributive surface controlling a flow of the coating material to an active edge of the ultrasonic horn;

atomizing the coating material at the active edge of the ultrasonic horn and directing the atomized coating material onto a surface of the print substrate; and applying the coating material in a helical pattern on the print substrate.

32. A method for applying a coating material onto a print substrate, comprising:

positioning an ultrasonic horn substantially horizontally relative to the print substrate;

delivering a supply of the coating material, which is capable of forming a lithographic printing form upon subsequent imaging, to a distributive surface of the ultrasonic horn, the distributive surface controlling a flow of the coating material to an active edge of the ultrasonic horn; and atomizing the coating material at the active edge of the ultrasonic horn and directing the atomized coating material onto a surface of the print substrate.

33. A method for applying a coating material onto a print substrate, comprising:

positioning an ultrasonic horn along at least a partially horizontal vector, relative to the print substrate;

delivering a supply of the coating material, which is capable of forming a lithographic printing form upon subsequent imaging, to a distributive surface of the ultrasonic horn, the distributive surface controlling a flow of the coating material to an active edge of the ultrasonic horn; and atomizing the coating material at the active edge of the ultrasonic horn and directing the atomized coating material onto a surface of the print substrate.

34. A method for applying a coating material onto a print substrate, comprising:

delivering a supply of the coating material, which is capable of forming a lithographic printing form upon subsequent imaging, to a distributive surface of an ultrasonic horn via a capillary tube, the distributive surface controlling a flow of the coating material to an active edge of the ultrasonic horn; and atomizing the coating material at the active edge of the ultrasonic horn and directing the atomized coating material onto a surface of the print substrate.

* * * * *